United States Patent [19]

Schwab et al.

[11] 4,110,086

[45] Aug. 29, 1978

[54] METHOD FOR IONIZING GASES, ELECTROSTATICALLY CHARGING PARTICLES, AND ELECTROSTATICALLY CHARGING PARTICLES OR IONIZING GASES FOR REMOVING CONTAMINANTS FROM GAS STREAMS

[75] Inventors: James J. Schwab, Seattle; David B. Goodson, Renton, both of Wash.

[73] Assignee: Air Pollution Systems, Inc., Kent, Wash.

[21] Appl. No.: 711,494

[22] Filed: Aug. 4, 1976

Related U.S. Application Data

[63] Continuation-in-part of Ser. No. 498,409, Aug. 19, 1974, abandoned.

[51] Int. Cl.[2] ..... B03C 3/14

[52] U.S. Cl. ..... 55/7; 55/10; 55/13; 55/107

[58] Field of Search ..... 55/2, 7, 10, 13, 108, 55/119, 120, 122, 124, 130, 140, 146, 150, 154, DIG. 38, 107; 261/DIG. 54; 310/6, 10

[56] References Cited

U.S. PATENT DOCUMENTS

| | | | |
|---|---|---|---|
| 1,475,995 | 12/1923 | Heis et al. | 55/150 |
| 2,864,458 | 12/1958 | De Graaf et al. | 55/154 |
| 2,956,640 | 10/1960 | Tuche et al. | 55/118 |
| 3,131,237 | 4/1964 | Collins, Jr. | 261/DIG. 54 |
| 3,400,513 | 9/1968 | Boll | 55/146 |
| 3,405,291 | 10/1968 | Brandmaier | 55/146 |
| 3,668,835 | 6/1972 | Vicard | 55/124 |
| 3,874,858 | 4/1975 | Klugman et al. | 55/118 |
| 3,959,420 | 5/1976 | Geddes | 261/DIG. 54 |

FOREIGN PATENT DOCUMENTS

| | | | |
|---|---|---|---|
| 334,786 | 8/1934 | Fed. Rep. of Germany | 55/150 |
| 1,245,327 | 7/1967 | Fed. Rep. of Germany | 55/117 |
| 351,257 | 2/1961 | Switzerland | 55/150 |

*Primary Examiner*—Frank W. Lutter
*Assistant Examiner*—David L. Lacey
*Attorney, Agent, or Firm*—Seed, Berry, Vernon & Baynham

[57] ABSTRACT

A venturi increases the velocity of contaminated gases and guides the gases past a high, extremely dense electrostatic field presented perpendicular to the gas flow and extending radially outward between a central, accurately sized disc electrode and the surface of the venturi throat. Downstream, charged particles are collected by a wet scrubbing process or electrostatic precipitator.

30 Claims, 16 Drawing Figures

FIG. 1
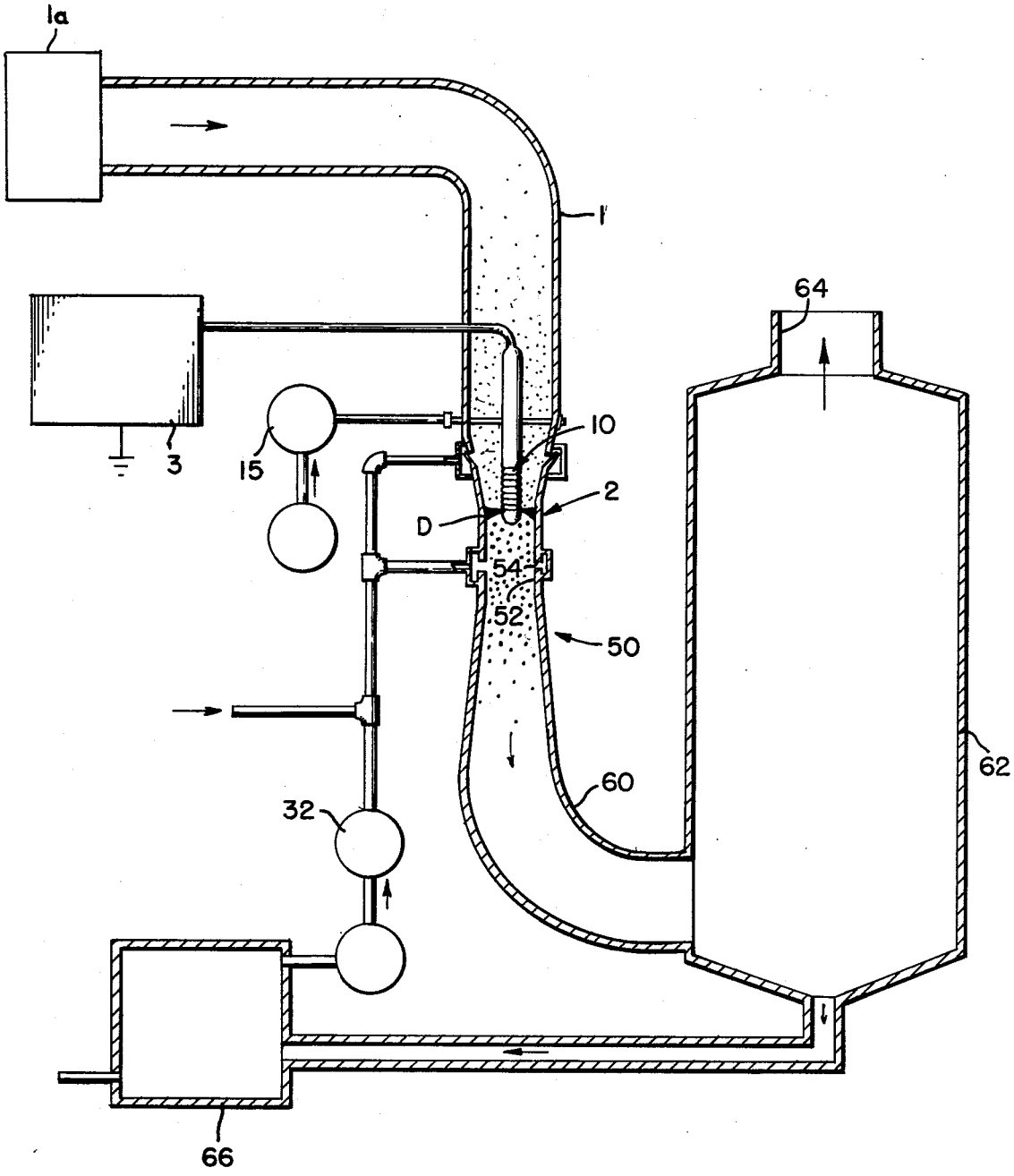
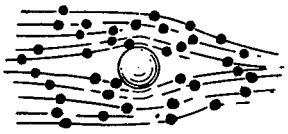
FIG. 1A
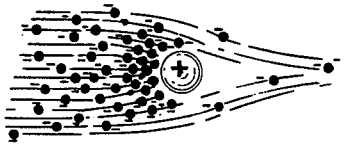
FIG. 1B

METHOD FOR IONIZING GASES, ELECTROSTATICALLY CHARGING PARTICLES, AND ELECTROSTATICALLY CHARGING PARTICLES OR IONIZING GASES FOR REMOVING CONTAMINANTS FROM GAS STREAMS

CROSS REFERENCE TO RELATED APPLICATIONS

This application is a continuation-in-part of application Ser. No. 498,409, filed Aug. 19, 1974, now abandoned.

BACKGROUND OF THE INVENTION

1. Field of the Invention

This invention relates to processes and apparatuses for the cleaning of contaminated gases, to processes and apparatuses for ionizing gases or charging particles in fluid streams, and to processes and apparatuses for increasing the efficiency of wire-plate ionizers.

2. Description of the Prior Art

Many industrial processes discharge considerable amounts of atmospheric contaminants as particulates in the sub-micron range. This type of particulate is most difficult to control. Fine particulate emission is becoming a major source of air pollution as the larger particulate problems have been easier to bring under control.

Currently, there are three basic approaches to the problems of handling sub-micron sized particulates in contaminated gases. The first approach is the traditional electrostatic precipitator system. The application of electrostatic precipitators to fine particulate control has several inherent problems.

The second basic type of cleaning system is the wet scrubbing approach. The wet scrubbing approach as applied to the control of fine particulates generally is of the high-energy venturi type. In order to capture the sub-micron particulates in water droplets, large quantities of water must be injected and high relative velocities employed. Both of these factors increase the pressure drop of the system, and operating cost is directly related to this pressure drop.

The third basic type is generally referred to as the dry filter system. A problem with equipment of this type, however, is the temperature limitation of the filter elements, the related problem of the high cost of reducing this temperature, and the difficulty in handling certain types of particulates such as "sticky" dusts.

Efforts have been made to improve the efficiency of the various techniques by electrostatically precharging the contaminants upstream of the primary collecting system. These efforts have generally been unsuccessful due primarily to the lack of an effective mechanism to produce a continuous, sufficiently intense field to adequately charge and affect the sub-micron sized particles.

Ionizers for charging particles or ionizing gases have heretofore been of the wire-cylinder, wire-plate or needle point type and have been limited to field intensities of about 10 kv/cm$^3$ in the interelectrode region. As a result, the usefulness and effectiveness of such ionizers have been limited.

SUMMARY OF THE INVENTION

It is an object of this invention to provide a process and apparatus for efficiently removing sub-micron sized contaminants along with the larger particles from contaminated gases such that the gases can be discharged into the atmosphere without accompanying air pollution.

A further objective of this invention is to accomplish the removal of the contaminants with equipment of compeititive initial sales price.

A still further object of this invention is to accomplish the removal of the contaminants with equipment of low installation cost.

A still further objective of this invention is to provide a process and apparatus which will substantially reduce operating costs, both from power consumption and maintenance, and still accomplish the desired removal of sub-micron contaminants.

According to one aspect of this invention, these objects are obtained by the method of flowing a gas containing contaminants into a venturi to increase the velocity thereof, exposing the gases in the venturi throat to a high, extremely dense electrostatic field presented perpendicular to the flowing gases and passing through this field at elevated velocity, electrostatically charging the contaminants (particles and, to a lesser extent, ionizing gases) to either a positive or a negative polarity, depending on the nature of the field in the venturi throat, and collecting the charged contaminants.

According to another aspect of this invention, a particularly configured electrode, in the shape of a toroidal surface, is placed at an accurately located distance from an annular outer electrode whose surface is adequately cleaned to prevent charged particle deposition, and contaminant-containing gas is passed through the resulting electrostatic field at a particular velocity to electrostatically charge the contaminants. The electrode configuration, surface cleaning and related gas velocity provide a high-intensity electrostatic field between the electrodes without producing the voltage breakdown normally expected in such a high-intensity field.

The contaminants can be collected by any of several conventional techniques, such as electrostatic precipitation, wet scrubbing or a combination of these techniques, depending on the nature of the particular collection device employed.

Two types of collection devices successfully employed will be discussed.

It is another object of this invention to provide a general purpose ionizer.

It is another object of this invention to provide an ionizer capable of creating extremely high field intensities without spark breakdown.

It is another object of this invention to provide a method and apparatus for charging gas particles in fluid streams or ionizing gases such as for electrical power generation, such as EGD, or for gas phase reactions, respectively.

Basically, these objects are obtained by passing appropriate gas streams through the ionizer at high velocities, with or without cleaning of the outer wall of the venturi, depending on the nature of the gas stream.

It is another object of this invention to provide an improved method and apparatus for increasing the field intensity and ion density of conventional wire-plate ionizers.

Basically, this object is obtained by increasing the velocity of the stream to be ionized as it passes the wire-plate to improve the stability of the corona discharge. With increased stability the field intensity can be increased thus allowing a given charge to be placed on a particle in a shorter distance or placing a greater charge on the particle within a fixed distance. Wire-plate, as used herein, also applied to other electrode configurations having a partially linear electrode configuration such that the field does not expand both axially and transversely of the stream path of flow. A race-track electrode configuration with curved ends and linear, parallel sides is one such example.

BRIEF DESCRIPTION OF THE FIGURES OF THE DRAWING

FIG. 1 is a longitudinal section of one embodiment of an apparatus embodying the principles of the invention.

FIGS. 1A and 1B are schematic illustrations of contaminated particle paths in a conventional wet scrubber and in a system highly charged according to the principles of this invention, respectively.

DETAILED DESCRIPTION OF THE PREFERRED EMBODIMENTS

Figure 2:
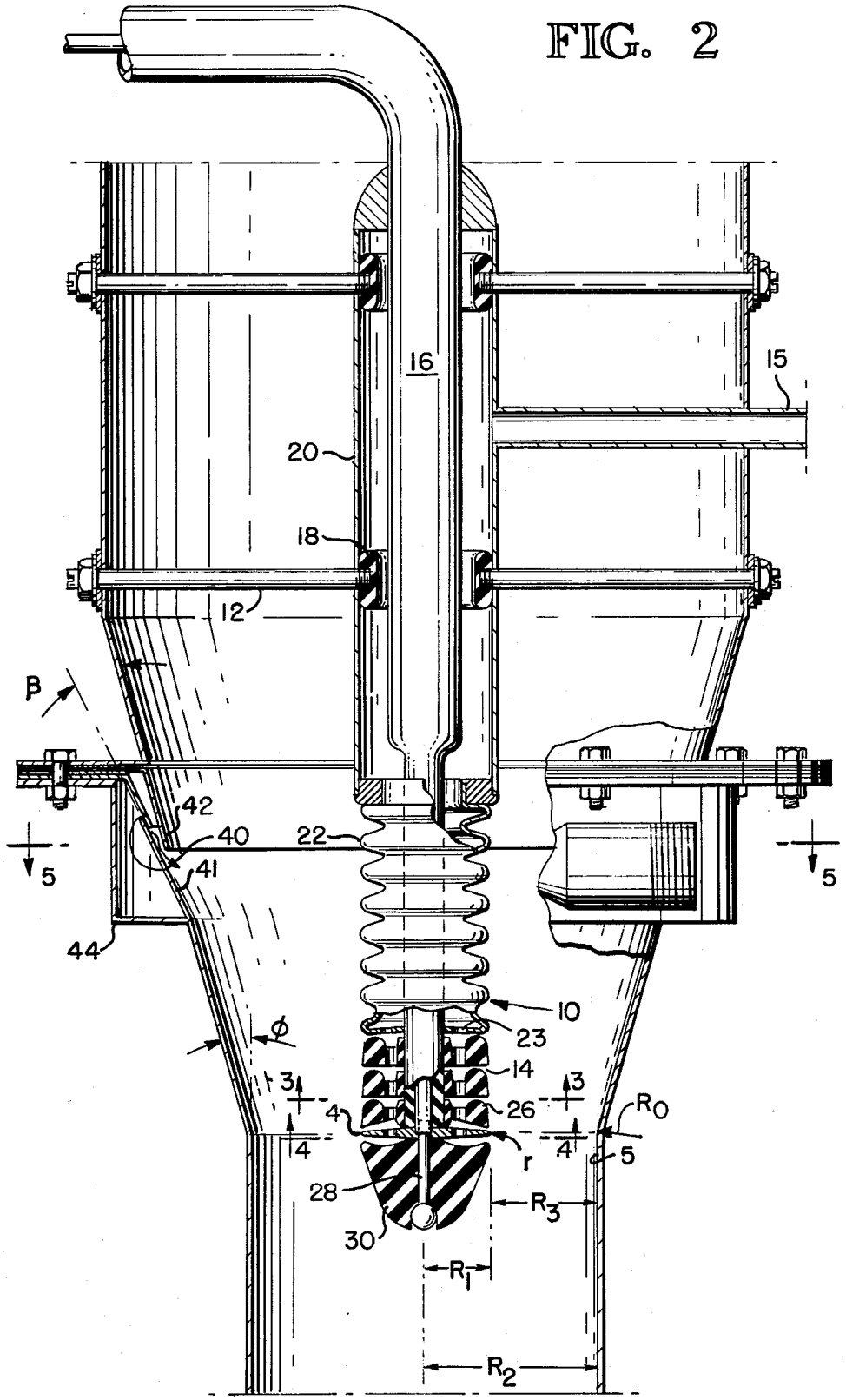
FIG. 2 is a fragmentary, enlarged section of a portion of the apparatus shown in FIG. 1.

Referring to FIG. 1, the gas containing the contaminants is directed through an inlet duct 1 by a blower 1a to the entrance of a gas contaminant-charging venturi section 2. The gases and contaminants are accelerated to an elevated velocity that will be a maximum in the venturi throat. The principles of the invention however are applicable also to constant velocity gas stream in which a venturi is not employed. A high intense corona discharge is maintained in the venturi throat by a high-voltage DC power supply 3. the discharge D propagates from a highly stressed electrode disc 4, centered in the venturi throat, to the outer wall 5 of the venturi in a radial direction. The corona discharge is extremely thin (less than one diameter of the outer electrode 5) in the direction of the gas flow and, hence, the resident time of the contaminant particles in the electrostatic field is short. A high level of electrostatic charge is imposed on the particles, however, for several unique reasons.

In accordance with conventional practice, the term "electric field" as used herein shall designate a non-corona field while the term "electrostatic field" as used herein shall designate a corona field.

Although an electrode having the shape of a disc is shown and will be described in detail, a toroid, ellipsoid (ring or solid disc) or other configuration having a smooth radial periphery may also be used. Similarly, the outer edge shape of the electrode 4 at the radius r, in cross-section as viewed in FIG. 2, need not be circular. Other designs that can be used include, for example, paraboloids, ellipsoids, or wedges with a curved edge radius. See, for example, in FIGS. 10A–10D. It is also possible to use electrodes with serrated edges. The term radial or radius of the edge as used herein is intended to cover all such configurations. (The electrode 4 in the preferred embodiment is electrically isolated by two adjacent dielectric insulators 26 and 28, to be described, which also appear to affect spark breakdown but as yet in an undetermined manner.)

While optimum performance is obtained by centering the inner electrode 4 concentrically within the venturi throat wall 5 (outer electrode), it will be understood by one skilled in the art that the apparatus will function effectively with off-center positioning as well.

Furthermore, the radius of curvature $R_O$ of the outer electrode 5 as shown in an axial cross-section through the outer electrode can vary to some extent, but best results are obtained with ratios of above 50:1 relative to the inner electrode edge radius *r*.

The axial location of the electrode 4 within the venturi throat can be varied within limits. Shifting the location upstream increases the gap $R_3$ to reduce the field intensity and requires higher voltage requirements but reduces the velocity of the contaminated gas stream. Reducing velocity both aids and detracts from ionizing efficiency within limits which will be described.

All of the above variations of the preferred illustrated configuration will degrade the performance to some degree; however, many operations or uses of the invention will not be necessary to obtain maximum operating conditions, and more economical construction techniques may suggest the use of one or more variations with acceptably lower ionizing efficiency.

Thus far the invention has been described as an ionizer for use upstream of a contaminant cleaning apparatus, such as a scrubber or precipitator, to substantially increase the efficiency of the cleaning apparatus. The ionizer, however, has other applications as well. For example, it may be used merely to charge particles for electrical power generation, i.e., EGD (electro-gas-dynamic) generation, or ionize gas streams for gas phase reactions, for example, generating atomic oxygen for oxidizing reactions, such as ozone generation for odor removal or sulphur dioxide to sulphur trioxide reactions. In these applications, a gas stream at the velocities described herein is directed past the ionizer in the same manner as the contaminated gas stream but it may be desirable to limit the passage of the gas through the field to a specific radial location. However surface cleaning of the outer electrode is not necessary if particle deposition does not occur.

Figure 7:
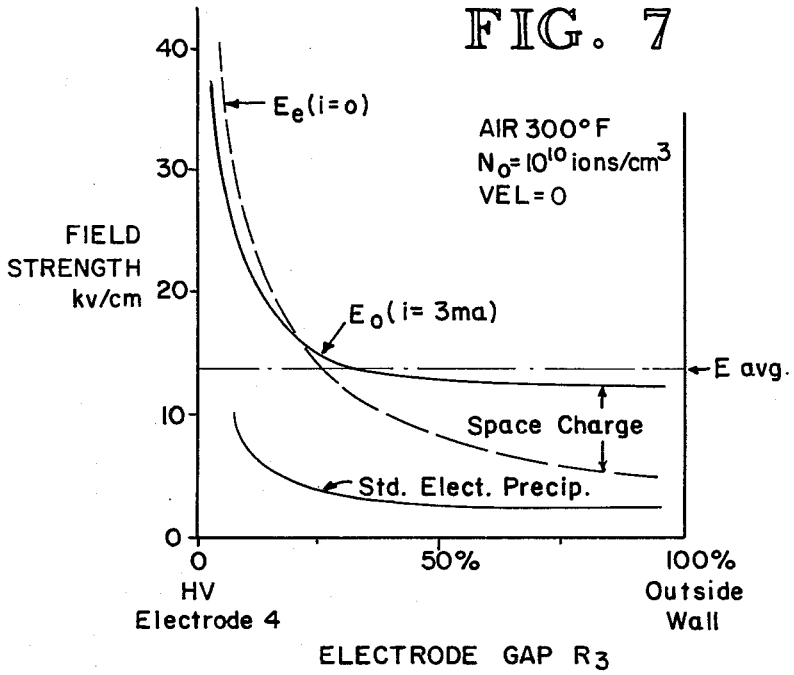
FIG. 7 is a diagram of the electrostatic field between the electrodes of the invention.

The electrostatic field Eo sustained between the electrode 4 and outer venturi throat wall 5 is comprised of two elements, an electric field Ee and a space charge influence, as shown in the chart of FIG. 7. The electric field is related to the applied voltage and the electrode geometry. The space charge influence, comprised of ions, electrons and charged particles in the interelectrode region, is created after corona discharge has been initiated. As shown in FIG. 7, the space charge influence tends to amplify the field in the region closer to the outer venturi throat wall and suppresses the highly intense field closer to the electrode. This effect stabilizes the corona discharge while allowing a high electrostatic field to bridge the entire interelectrode region $R_3$. This is accomplished without spark breakdown by electrode design, maintaining a high velocity in the region and a clean surface on the outer electrode 5.

To best understand the uniqueness of the inventive electrostatic field reference is made to electrostatic fields produced by two types of well known prior art electrode configurations. In a wire-cylinder electrode configuration a wire extends along the axis of a cylinder. The electric field between the cylinder and the wire is entirely radial with no components (neglecting edge effects at the ends of the cylinder) extending along the axis of the cylinder. When a voltage is initially placed between the wire and cylinder a space charge is not present. The intensity of the electric field at any point between the wire and cylinder is inversely proportional to the distance from the wire so that the intensity of the field continuously decreases radially outward from the wire toward the cylinder. As the voltage between the wire and cylinder increases to a corona starting voltage, the electrons in the air adjacent the wire (where the field is the greatest) are accelerated toward the cylinder (assuming a negative voltage on the wire), impinging on gas molecules driving off additional electrons. Since the molecules have now lost an electron, they become positive ions which, by virtue of the wire's negative potential, accumulate adjacent the wire. The space charge continues to build up by a phenomena commonly known as the "avalanche process". In the avalanche process the high energy electrons accelerated radially outward by the electrostatic field strike additional molecules. The extremely high energy of the electrons allows them to separate electrons from the nucleus of the molecule thereby creating additional free electrons e- and additional positive ions. It is to be emphasized that the avalanche process occurs only near the wire since it is in this region that the field is the greatest. As the electrons migrate radially toward the cylinder, the deceleration caused by striking molecules exceeds the acceleration caused by the field since the intensity of the field is reduced away from the wire. At points where the field is approximately 30 kv/cm and below, the free electrons, instead of freeing additional electrons by the avalanche process, attach to electronegative gas molecules to form negative ions such as from $O_2$ to $O_2^-$ when air is the gas between the electrods. Oxygen is the only major electronegative component of air. Thus, for air the only negative ion is the $O_2^-$ ion. However, other negative ions may be formed for other electronegative gases. Other commonly produced electronegative stack gases include $SO_2$, water vapor and $CO_2$. The $O_2^-$ ions are accelerated toward the positive potential cylinder where, on route, they form a negative ion space charge in the inter-electrode region. In summary, in the area adjacent the wire where the field is greater than 30 kv/cm, electrons which are accelerated by the field have sufficient kinetic energy so that when they strike molecules a free electron and a positive ion is formed by the avalanche process. Away from the wire, the electrons of reduced energy attach to oxygen molecules forming $O_2^-$ ions. As positive ions accumulate adjacent the negative potential wire and $O_2^-$ ions accumulate between the positive space charge and the cylinder, the electric field is modified so that the intensity of the electrostatic field adjacent the wire is reduced while the intensity of the electrostatic field toward the cylinder is increased. The reduced electrostatic field adjacent the wire reduces the quantity of free electrons and positive ions produced by the avalanche process, and the increased electrostatic field adjacent the cylinder increases the migration of $O_2^-$ ions toward the cylinder. The result is a stabilizing, or negative feedback, effect which maintains the space charge density relatively constant with time. Even though the $O_2^-$ ions increase the intensity of the field adjacent the cylinder, the increase is insufficient to prevent the intensity of the field from continuously decreasing toward the cylinder.

Electrostatic fields produced by the wire-cylinder electrode configuration are relatively inefficient since the relatively large area of the cylinder walls results in a large inter-electrode current flow to maintain a given average field intensity.

The second conventional electric field to be examined is that of the wire-plate in which a potential is placed between a wire positioned in parallel between a pair of parallel plates. With this type of electrode configuration, the gas stream passes through the field along a line perpendicular to the wire and parallel to the plates. The electrostatic field generated by a wire-plate electrode configuration produces a space charge in the same manner as the wire-cylinder electrode configuration. However, since the electrostatic field adjacent the plates is more intense directly across from the wire, the space charged formed by the $O_2^-$ or negative ions from other electronegative gas is more concentrated in this area. This is in contrast to the negative ion distribution of the wire-cylinder electrode configuration where the negative ion concentration is uniformly distributed around the periphery of the cylinder. The space charge amplification of the wire-plate electrostatic field is most intense opposite the wire so that the intensity of the electrostatic field between the wire and plate is greatly increased toward the plate. The high electrostatic field at the plates and high local current deposition causes sparkover unless the average field intensity is maintained at a relatively low value. Therefore, with a wire-plate electrode configuration, it is not possible to achieve relatively large average electrostatic fields. With the wire-plate electrode configuration, as with the wire cylinder, the electrostatic field, (neglecting edge effects at the ends of the wire) does not vary along the axis of the wire. In other words, the components of the electrostatic field extend in only two directions of a cartesian coordinate system and result in nonuniform electrostatic fields.

In the inventive electrode configuration the disc electrode 4 (or racetrack configuration, FIG. 11) concentrically placed within the cylindrical outer electrode 5 creates an electrostatic field having components which extend along the three dimensions of a cartesian coordinate system. The X and Y components of the field (or the R components in a cylindrical coordinate system) are substantially identical to the electric field of the wire-cylinder when viewed along the axis of the cylinder. Thus, the concentration of negative ions in the inter-electrode gap in a plane transverse to the outer electrode 5 is uniform about the periphery of the disc electrode 4 resulting in uniform space charge amplification of the electrostatic field. However, the electric field between the disc electrode 4 and the outer electrode 5, when viewed in a plane axial of the outer electrode 5, is substantially identical to the electric field of the wire-plate electrode configuration. The concentration of negative ions in a plane passing through the axis of the outer electrode 5 is greater in the plane of the disc electrode 4 than at points axially spaced therefrom.

The intensity of the electric field as a function of the distance from axis of the disc electrode 4, as illustrated by the broken line in FIG. 7, continues to decrease from the disc electrode 4 toward the outer electrode 5. The intensity of the electrostatic field including the space charge amplification, as illustrated by the solid line in FIG. 7, is substantially constant and slightly less than the average applied field throughout a substantial distance from the outer electrode 5 toward the disc electrode 4 so that the electrostatic field is substantially uniform within a generally wedge shaped volume diverging outwardly in a direction perpendicular to the gas flow as illustrated at D in FIG. 1. As is well known in the art, the average applied field is defined as the ratio of the interelectrode voltage to the interelectrode distance. Thus the field has a radial dimension approximately equal to its axial dimension at the outer electrode 5. The uniform space charge distribution occurring in a plane transverse to the disc electrode 4 has some of the characteristics of a wire-cylinder type electrostatic field in which the field continues to decrease as the outer electrode 5 is approached. The non-uniform ion concentration occurring in the axial plane of the disc electrode 4 has some of the characteristics of a wire-plate type electrostatic field in which the intensity of the field is increased toward the outer electrode 5. The inventive electrostatic field, by simulating a wire-cylinder electrostatic field in one plane and a wire-plate electrostatic field in an orthogonal plane, combines the continuously decreasing electrostatic field of the wire-cylinder with the continuously increasing electrostatic field of the wire-plate to produce an electrostatic field having an intensity which is substantially uniform in both a radial and circumferential direction throughout a substantial distance from the outer electrode 5 toward the disc electrode 4 within a generally wedge shaped volume diverging outwardly in a direction perpendicular to the gas flow. Thus the field between the electrodes 4,5 has a radial dimension equal to the spacing between the electrodes 4,5 which is approximately equal to the axial field adjacent the outer electrode 5, i.e. the dimension of the field adjacent the outer electrode 5 in a direction perpendicular to a plane passing through the electrodes 4,5. The uniformity of the electrostatic field allows a highly intense average field without producing sparkover since there is no point at which the field becomes excessively intense, such as at the plate of a wire-plate system, which limits the average intensity of the field which can be applied without sparkover. The electrostatic field configuration is also less prone to sparkover because it delivers far less current per unit area at the outer electrode at a given field intensity than the wire-plate electrode configuration.

Both the wire plate and wire cylinder generate electrostatic fields which are elongated systems and contact relatively large areas thus causing a relatively large current flow. As a result, the inventive electrode configuration is able to maintain a highly intense electrostatic field utilizing a minimum of current (and hence, power) without causing sparkover between the electrodes.

Cleaning of the outer electrode surface is necessary only to maintain the surface relatively clean to minimize spark breakdown. Where maximum field intensity is not necessary and lower voltages can be applied, the ionizing occurs in clean gas streams; or during other conditions not producing serious buildup on the surface, cleaning or flushing is, of course, not required. Also, intermittent cleaning may be used.

The inner electrode design introduces large amounts of current (ions) by corona discharge due to the intense field close to the electrode surface. The electrode design also provides a concentrated electric field region all the way to the venturi throat wall 5, but at a sharply decreasing magnitude. This concentrated residual field directs the space charge on this path in its migration to the wall and is responsible for the proper field amplification. The smoothly curved, generally radial periphery of the inner electrode causes the space charge to expand circumferentially in the throat, reducing the current deposition per unit area at the outer electrode to reduce potential spark breakdown.

Since the electrostatic field is relatively thin in the direction of the gas stream, higher velocities of gas flow through the field tends to diffuse the ion concentration axially from the plane of the inner electrode. This adds further stability by expanding the space charge region in the direction of flow to decrease electrostatic field between the space charge region and outer electrode 5. This "velocity enhancement" effect is maximized at gas velocities of 50 fps and above. In addition, turbulence at these high velocities may also provide stability by mechanically disrupting the mechanism which causes spark breakdown.

To maintain the corna and, hence, the performance of the charging unit from contamination and degradation, the disc electrode 4 is isolated from other leakage paths besides the corona discharge. As best shown in FIG. 2, a probe 10 supports the electrode 4 in its proper location in the outer electrode 5 and provides high resistance to electrical leakage both internally and on its surface. Although not shown, the probe can be moved axially or laterally if desired. The resistance is provided between the electrode and the support structure 12 of the probe in the upstream duct 1. Surface resistance is improved by providing one or more clean air bleeds 14 which are continuous slots (0.030 inch) around the circumference of the probe just upstream of the electrode 4. Clean air, provided by an outside supply 15, is fed through the probe body and passes out these slots at high velocity. This action maintains a positive high-resistance path that the surface leakage would have to "bridge" to short the electrode 4 to ground.

Figure 3:
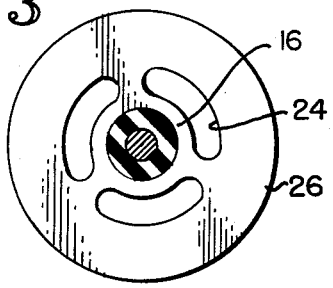
FIG. 3 is a transverse section taken along the line 3—3 of FIG. 2.

The probe body includes a high-voltage cable 16 supported by dielectric hubs 18 which secure the probe to the duct 1. The upstream end of the probe body is contained in a closed shroud 20 and a hollow, corrugated cover 22. Openings 23 allow passage of the air axially to a plurality of spaced rings 26, each with corresponding slots 24 (FIG. 3). The spacing forms the series of continuous slots 14 for bleeding the air as mentioned above.

Electrode 4 also has slots 24 which allow air flow downstream of the electrode. The rings and electrode disc are secured to the cable 16 by a bolt 28 fitted in a nose 30. The nose and clean air from the downstream side of the electrode prevent stagnation of charged contaminants downstream of the disc electrode 4 and prevent deposition of particles on the surface of the electrode 4.

The outer electrode 5, because of contaminant buildup, is kept smooth and reasonably clean for a short distance of several times the corona gap $R_3$. This assures that disturbances in the corona from the outer electrode surface, such as contaminant buildup, will be eliminated. This cleaning can be accomplished in several ways; one technique is shown in FIGS. 1 and 2. Water or a similar fluid is injected by an external pump 32 in a smooth layer on the surface of the converging cone section of the venturi wall 5. Where the outer electrode 5 is a venturi the angles of convergence phi of the venturi is held at about 12.5° half angle to minimize turbulent flow effects. Half angle as used herein as defined as one-half the angle between the side walls of a converging cone or equal to the angle of one side wall with respect to the longitudinal axis of the cone. The venturi in use is pointed in a downward direction and the water film is accelerated as it approaches the throat, both from gravity and friction with the moving gases. The point of water injection is about 1.5 electrode gap $R_3$ lengths line-of-sight upstream from the electrode 4. The term "line-of-sight upstream from the electrode 4" being defined as the distance between the outer periphery of the electrode 4 and the inner wall of the outer electrode 5. By simple trigonometry, this corresponds to approximately 1.12 electrode gap $R_3$ lengths axially upstream from the plane electrode 4 intersecting the outer electrode. The expansion of the downstream divergent cone of the venturi is less than 3.5°, again to minimize effects from flow separation. The radius $R_0$ that forms the transition between these angles should be no smaller than about 2 inches. Water injection is accomplished by a weir arrangement including a thin (0.010–0.025 inch) continuous slot 40 formed by a surface 41 on the circumference of the converging cone with a nozzle direction beta of about 12.5° half angle to the side wall of the venturi. The action of the water on the wall of the venturi maintains a smooth, clean surface without degrading corona performance for velocities of gas flow up to about 76 fps. Water consumption varies with venturi size and ranges from 0.2 to 2 gpm/1000 acfm for 5 to 50 inch venturi diameters.

Water is prevented from migrating upstream along the outer electrode 5 by providing an inwardly directed band or deflector 42 insulated from the cooler water. The water from pump 32 is directed under pressure tangentially into a housing 44 and leaves the housing through slot 40 in an axial direction to minimize spiralling of the water as it passes through the electrostatic field.

To develop the intense corona and sustain highly efficient, stable performance, the key elements in the units must be optimized. The discharge electrode radius *r* is cut on the outer periphery of the discharge electrode 4 contained by the probe. For best performance, based on present experimental data, this radius should be designed such that the ratio of electrode gap $R_3$ to the discharge electrode 4 radius *r* is about 100:1. If the ratio is set below 50:1, sparking will occur at low applied voltage, yielding a low operating current and field. If the ratio exceeds 400:1, the electric field contribution in the gap is reduced, which results in higher operating current to maintain the high fields. The outer electrode 5 should have a radius $R_0$ when viewed in axial cross-section which is no less than a ratio 50:1 with the discharge electrode radius *r*. Smaller radii will induce sparking at lower applied voltages. The diameter of the probe 10 and, hence, the overall diameter of the discharge electrode 4, should be set such that the probe occupies around 10% of the cross-sectional area of the outer electrode 5. A practical minimum is 5%. A probe occupying a smaller percentage of the outer electrode 5 causes an increase in discharge electrode surface power density. More importantly, smaller values also increase the electrode gap for constant flow capacity of the unit, thereby increasing power supply voltage requirements significantly. Values greater than 10% increase size of the outer electrode 5 and probe cost and increase probe isolation air bleed requirements and, hence, operational cost. With these electrode geometries, typical high-voltage requirements are such that an average field of about 18–20 kv/cm can be maintained across the electrode gap $R_3$ at standard atmospheric conditions (a pressure of 29.92 inches of mercury and a temperature of 70° fahrenheit) and zero velocity. With gas velocities greater than about 50 fps, the field can be increased to about 24–28 kv/cm without sparking.

Several important functions occur in the highly intense corona region of the charging unit. The suspended contaminants are field charged by the strong applied fields and ion impaction in the high ion-dense environment of the electrode gap $R_3$. It is presumed that the diffusion charging mechanism has minor contribution here on the fine particles due to the short residence time of the particles in the corona. There will be a slight displacement of the particles outward radially as they become charged and migrate in the strong fields of the corona. The amount of this displacement will vary with the size of the particle so some mixing, impaction and possible agglomeration can occur. This is seen as a minor effect in view of the thermal agitation and flow turbulence present. In the case of liquid aerosols, however, the effects of strong applied fields (greater than 10 kv/cm), high temperatures and turbulet mixing, cause significant agglomeration to occur, and this effect has been witnessed downstream of the corona. This can be of great benefit in the collection of fine aerosols as particles agglomerate and "grow" to larger, more easily collected sizes.

Velocity of the gases through the highly charged corona areas affects the charging efficiencey of the system. Above about 50 fps, the space charge region of the field becomes axially spread by the gases to reduce the possibility of a spark breakdown, that is, greater stability of the corona is achieved. With the increases in velocity, however, the advantage of increased stability begins to become offset by the disadvantage of the shorter resident time of the contaminants in the field, and thus a reduction in charge on the particles, and increased disruption of the water film on the outer electrode wall if water cleaning is used. Up to about 125 fps, there is a gain in stability of the corona, but with a decrease in charging efficiency. For one system tested, the maximum charge on the particulate appears to occur at about 100 fps. To a great extent, however, gas velocity must be a trade-off between the capacity needed for efficient operation of the industrial gases being cleaned, electrode voltage requirements and venturi wall cleaning capability.

Figure 6:
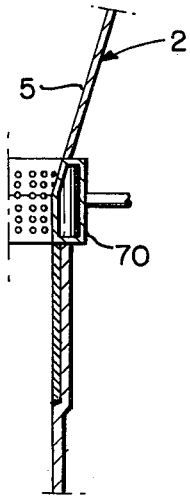
FIG. 6 is a fragmentary, diametrical section of the throat of a modified venturi wall.

A second method of venturi wall cleaning is illustrated in FIG. 6. In this embodiment, a perforated or porous air bleed section 70 is provided on the outer electrode 5 adjacent the discharge electrode 4 to provide an air film over the downstream wall of the outer electrode 5 rather than water film. Downstream of the air bleed section 70 for a distance of several electrode gap $R_3$ lengths, the outer electrode 5 wall surface is coated with a material of high electrical resistivity for providing electrical isolation of the particles deposited in this area.

Still another method is the use of gas stream erosion to limit the thickness of the deposition to permissible levels.

Still another method is to vibrate or shock the wall to intermittently or continuously dislodge the contaminants before buildup.

The suspended particulate contaminants having passed through the electrostatic field are highly charged, of like polarity and are migrating to the outer venturi wall 5 downstream of the corona. Deposition on the wall which occurs is minor and represents only those particles traveling near the wall on their original trajectories. Since the applied field in this region is primarily of the space charge element and, therefore, the migration velocities are low in comparison to stream velocities, the bulk of the particles remain in the stream for considerable distances. At least two forms of collection of these highly charged, suspended particulates can be employed.

One technique for collecting the charged particles is a conventional electrostatic precipitator. Another technique is a wet scrubber 50 to be described. The gas contaminant charging section of the outer electrode 5 is directly attached to the throat 52 of the venturi scrubber 50. In general, the design velocity of the outer electrode is consistent with the desired velocity in the scrubber venturi such that the charging section divergent cone angle is set at about 0°. The charged particle-laden gases pass through the scrubber venturi with the particles collected onto water drops by impaction and interception enhanced by the electrostatic forces. Water enters the venturi scrubber in a conventional manner as through a continuous slot 54 and is atomized by the gas stream. The water droplets are oppositely charged to the particles by induction because the atomization process occurs in a residual field region. Preferably, at low venturi velocities (below about 75 fps), the injection point should be at least two gaps $R_3$ downstream of the discharge electrode to prevent premature spark breakdown. At higher velocities, greater separation distances are required due to ions drifting downstream of the corona which tend to foul the induction process by undesirably charging the water droplets with the same polarity as the charged particles. By extending bolt 28, the induction charging field is increased axially, even though the separation distance between the electrode 4 and the injection point is increased. This also provides for a cylindrical field emitting from the bolt which drives the ions toward the outer wall 5 downstream of the electrode 4.

The collection efficiency of a conventional venturi scrubber depends upon the inertial impaction of particles on water droplets. The impaction is accomplished by high relative velocity of the contaminated air stream and water droplets injected at low velocity. The submicron sized particles escape impaction by following the slip stream around the water drops instead of impacting. (An example is illustrated schematically in FIG. 1A.) This is due to their high aerodynamic drag-to-inertia ratio. Particle bounce and rebound also become important considerations in cases of marginal impaction and interception energies. Particles with low impaction energies fail to penetrate the water droplet due to surface tension effects.

Particles containing a high (10kv/cm saturation charge) electrostatic charge and with induced charge on the water droplets, as in this invention, have an attractive force between the charged particles and water droplets sufficient to significantly effect their impaction trajectories, as shown schematically in FIG. 1B. This effect results in a substantial improvement in collection efficiency over the basic scrubber efficiency. The impaction improvement effect varies with particle size and the relative velocity between the particles and water droplets.

The sensitivity to particle size is minor with a variation in effect of only + or − 20% when considering 0.1. micron through 10 micron size particles. Since the longer the electrostatic forces have time to act, the more effective they become, lower relative velocities between charged particles and water drops yield a larger improvement effect. Since lower velocities also yield less effective atomization of the scrubber fluid and larger equipment sizes, an optimum velocity range becomes apparent.

Below about 50 fps relative velocity, atomization in the venturi scrubber degrades rapidly; therefore, liquid requirements increase substantially to maintain efficiency. About 200 fps relative velocity, pressure drop across the system due to water droplet acceleration losses becomes excessive. Therefore, the optimum improvement in collection efficiency of the gas contaminant-charging unit on a venturi scrubber collection occurs with venturi scrubber designs around 125–150 fps in the throat.

One tested embodiment of the invention employed a gap radius $R_3$ of 1 ½ inches, a discharge electrode edge radius $r$ of 1/64 of an inch, a peripheral radius $R_1$ of 0.875 inches, an outer electrode radius $R_2$ of 2 ⅜ inches, a converging cone angle phi of 12.5°, and an outer electrode (axial cross section) radius $R_0$ of 3–4 inches. The embodiment had a 750 cfm capacity with gas flow of about 120 fps in the scrubber venturi. Typical prior art "scrubber only" collection efficiency of this design is approximately 81% at a 0.5 micron particle size. Collection efficiency is increased to approximately 95% at 0.5 micron size when the gas contaminant-charging unit of this invention is activated. The system at this condition consumes approximately 7.5 gpm/1000 acfm of water, 150 watts/1000 acfm charging unit power and has 4 inches of water system pressure drop.

A second tested embodiment employs a gap radius $R_3$ of 2.15 inches, a discharge electrode edge radius $r$ of 1/64 of an inch, a peripheral radius $R_1$ of 0.875 inch, an outer electrode radius $R_2$ of 3.03 inches, a converging cone half angle of 15°, and a venturi radius $R_0$ of 2 inches. The embodiment had a 1,000 cfm capacity, with gas flow of about 150 fps in the scrubber venturi. The typical prior art "scrubber only" collection efficiency of this design is approximately 94.6% at a 1.25 micron particle size. Collection efficiency is increased to approximately 97.5% at 1.25 micron size when the gas contaminant-charging unit of this invention is activated. The system at this condition consumes about 6 gpm/1000 acfm of water, 150 watts/1000 acfm charging unit power and has 6 inches of water pressure drop.

Typical corona ionizing apparatus in the prior art have generally been limited to operating field intensities of 3–6 kv/cm. With the ionizer of this invention using the optimum electrode design and fluid velocity past the electrodes, operating field intensities up to 15 kv/cm are obtainable without spark breakdown.

Figure 8:
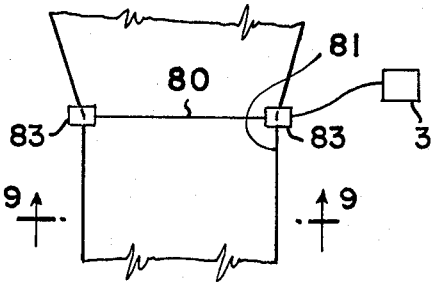
FIG. 8 is an axial section of a form of ionizer illustrating the principles of a second invention.
Figure 9:
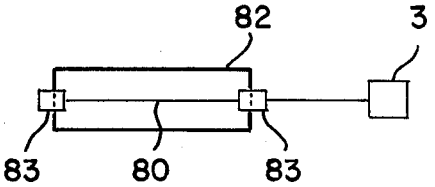
FIG. 9 is a transverse section of the embodiment of FIG. 8.
Figure 10A:
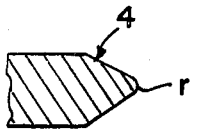
FIGS. 10A–10D are various edge radius shapes.
Figure 10B:
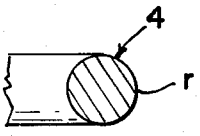
Figure 10C:
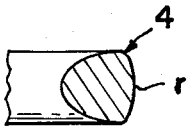
Figure 10D:
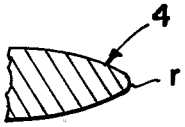

One incidental advantage of the invention occurs from the discovery that the velocity effect which axially diffuses the space charge to assist in reducing potential breakdown can be used advantageously alone with more conventional precipitation designs to greatly increase their operating field strength. For example, FIGS. 8 and 9 illustrate a known ionizer using a single wire electrode 80 placed transversely across a venturi throat 81 of a rectangular duct 82. Insulators 83 isolate the wire from the duct in a known manner. The wire is connected to power supply 3 as in the preferred embodiment.

Normally, a single wire-plate ionizer must be operated at low applied voltages such that the average field between the electrodes does not exceed about 10 kv/cm before spark breakdown. Velocities are kept low, at about 10 fps. A typical example of this operation is a home electrostatic air cleaner. Using the higher velocities of about 50 fps of this invention, average field intensities of above 10 kv/cm can be obtained without spark breakdown since the velocity sweeps the excess space charge downstream out of the most intense field.

By the same mechanism, multiple transverse wire precipitators having transverse wires spaced axially along a duct are also limited to low voltages, even with higher fluid velocities since the displacement of ions from one wire region will be then exposed to the next downstream field region.

Multiple transverse, axially spaced wires can be used, of course, if spaced axially sufficient distances apart to allow ions from each next upstream wire to migrate to the outer electrode (duct) prior to entering the ionizing field of the downstream wire.

Figure 4:
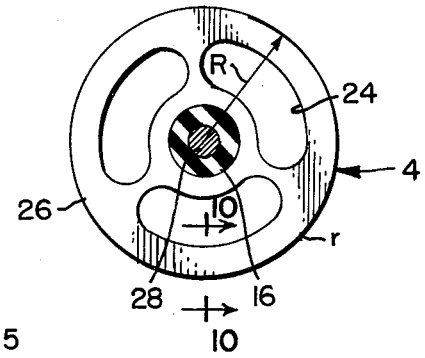
FIG. 4 is a transverse section taken along the line 4—4 of FIG. 2.
Figure 5:
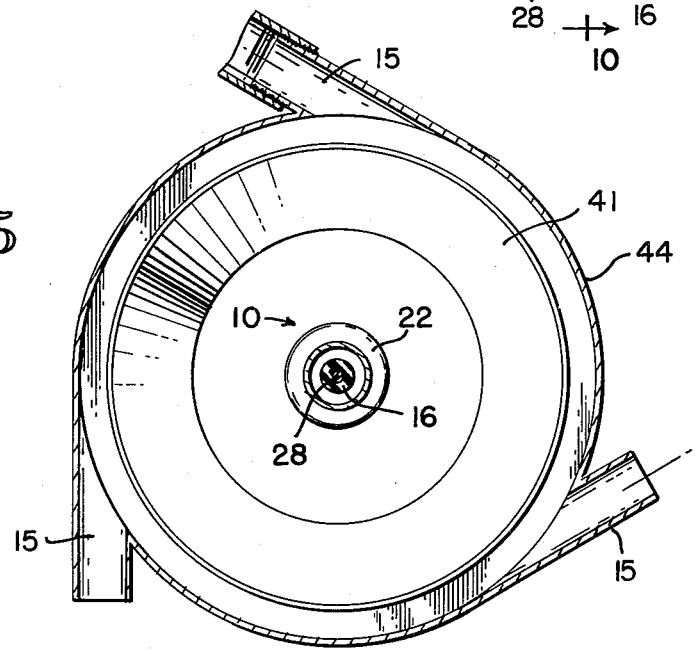
FIG. 5 is a transverse section taken along the line 5—5 of FIG. 2.
Figure 11:
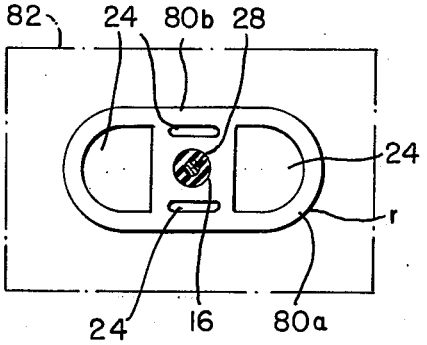
FIG. 11 is another embodiment of an ionizer.

FIG. 11 illustrates another embodiment of an inner electrode having electrode ends 80*a* of a radial configuration and central electrode portion 80*b* of linear configurations. Preferably, the duct 82 is again rectangular but could be curved to match the electrode. Air ports 24 are provided as shown in FIGS. 3–5. All of the shapes of FIGS. 10A–10D can, of course, be used for the edge radius *r*. The electrode configuration of FIG. 11 will perform most like the wire-plate electrode of FIGS. 8 and 9 but also will obtain some of the advantages of the more radial type electrodes.

The embodiments of the invention in which a particular property or privilege is claimed are defined as follows:

1. A method of removing contaminants from gases, comprising:

directing the contaminated gases through a tubular outer electrode;

placing an inner electrode with said outer electrode thereby forming an electrode gap between said electrodes;

generating an electrostatic field between said electrodes, the intensity of said field being approximately equal to the intensity of the average applied field throughout a distance from said outer electrode at least to about fifty percent of the electrode gap toward said inner electrode such that said field is substantially uniform and is generally wedge shaped diverging outwardly in a direction perpendicular to the flow of gases through said outer electrode, thereby charging the contaminants in said gases; and collecting the charged contaminants.

2. The method of claim 1 wherein said gases are passed through said field at a velocity of at least 50 fps.

3. The method of claim 1 further including the step of generating a film of fluid along the inside walls of said outer electrode thereby preventing said contaminants from accumulating on the walls of said outer electrode.

4. The method of claim 1 further including the steps of mounting said inner electrode on an insulated probe and providing an air stream extending continuously around the circumference of said probe thereby preventing said contaminants from accumulating in a continuous layer along the length of said probe.

5. The method of claim 1 further including the step of adjusting the ratio between the cross sectional area of said inner electrode and the cross sectional area of said outer electrode such that said ratio is between 0.05 and 0.1.

6. The method of claim 1 wherein said field has an average intensity equivalent to an average intensity in air of greater than 12 kv/cm at standard temperature and pressure.

7. A method of ionizing gases, comprising:

directing the gases through a tubular outer electrode;

placing an inner electrode within said outer electrode thereby forming an electrode gap between said electrodes;

generating an electrostatic field between said electrodes, the intensity of said field being approximately equal to the average applied field throughout a distance from said outer electrode at least to about fifty percent of the electrode gap toward said inner electrode such that said field is substantially uniform and is generally wedge shaped diverging outwardly in a direction perpendicular to the flow of gases through said outer electrode, thereby ionizing said gases.

8. The method of claim 7 wherein said gases are passed through said field at a velocity of at least 50 fps.

9. The method of claim 7 further including the steps of adjusting the ratio between the cross sectional area of said inner electrode and the cross sectional area of said outer electrode such that said ratio is between 0.05 and 0.1.

10. The method of claim 7 wherein said field has an average intensity equivalent to an average intensity in air of greater than 12 kv/cm at standard temperature and pressure.

11. The method of claim 10 wherein said field has an average intensity equivalent to an average intensity in air of greater than 15 kv/cm at standard temperature and pressure.

12. A method of creating a corona discharge within a tubular outer electrode comprising the steps of concentrically mounting an inner electrode with said outer electrode, and generating an isolated corona discharge electrostatic field between said electrodes, said corona discharge electrostatic field having a radial dimension approximately equal to the axial dimension of said corona discharge electrostatic field adjacent said outer electrode.

13. The method of claim 12 wherein the average intensity of said field is equivalent to an average intensity of air of greater than 12 kv/cm at standard temperature and pressure.

14. The method of claim 12 wherein the intensity of said field is approximately equal to the average applied field throughout a substantial distance from said outer electrode toward said inner electrode.

15. The method of claim 12 wherein said field has a wedge shaped cross section diverging outwardly from said inner electrode in a radial direction.

16. A method of creating a corona discharge between a pair of inner and outer concentric electrodes, said method comprising the step of generating an electrostatic field between said electrodes, the intensity of said field being approximately equal to the intensity of the average applied field throughout at least fifty percent of the distance from said outer electrode toward said inner electrode, and equivalent to an average intensity in air of greater than 15 kv/cm at standard temperature and pressure.

17. The method of claim 16 wherein the spacing between said electrodes is approximately equal to the dimension of said field in a direction perpendicular to a plane passing through said electrodes adjacent the outer of said electrodes.

18. A method of creating a corona discharge, comprising:

generating an electrostatic field defined in a cylindrical coordinate system as having radial and axial components, the field, when viewed in a radial cross section of said cylindrical coordinate system, being substantially identical to the electrostatic field between a concentric wire and cylinder when viewed along the axis of said cylinder, and said field, when viewed in an axial cross section of said cylindrical coordinate system, being substantially identical to the field between a parallel wire and plane when viewed along the axis of said wire.

19. A method for increasing the operating intensity of a relatively thin electrostatic field extending between a pair of electrodes and generally perpendicular to a gas stream, said method comprising adjusting the voltage between said electrodes and the velocity of said gas stream to allow the voltage between said electrodes to be increased beyond the normal sparkover voltage between said electrodes and zero velocity conditions such that said gas stream sweeps the excess spark charge downstream out of the electrostatic field thereby preventing sparkover between said electrodes at said increased voltage.

20. The method of claim 19 wherein the average intensity of the electrostatic field between said electrodes is equivalent to an average intensity in air of greater than 15 kv/cm at standard temperature and pressure, and the velocity of said gas stream is greater than 50 fps.

21. A method of removing contaminants from gases, comprising:

directing the contaminated gases along a path between a pair of concentric inner and outer electrodes;

generating in said path between said electrodes an electrostatic field having an average intensity approximately equal to the intensity of the average applied field throughout at least fifty percent of the distance from said outer electrode toward said inner electrode, and equivalent to an average intensity in air of at least 12 kv/cm at standard temperature and pressure, said field lying at right angles to said path such that said gases pass through said field thereby charging said contaminants; and collecting the charged contaminants.

22. The method of claim 21 further including the steps of mounting said inner electrode on an insulated probe and providing an air stream extending continuously around the circumference of said probe thereby preventing said contaminants from accumulating in a continuous layer along the length of said probe.

23. The method of claim 21 further including the step of adjusting the ratio between the cross sectional area of said inner electrode and the cross sectional area of said outer electrode such that said ratio is between 0.05 and 0.1.

24. The method of claim 21 wherein said field has radial and axial components in a cylindrical coordinate system, and said field, when viewed in a radial cross section of said cylindrical coordinate system, being substantially identical to the electrostatic field between a concentric wire and cylinder when viewed along the axis of said cylinder, and said field, when viewed in an axial cross section of said cylindrical coordinate system, being substantially identical to the field between a parallel wire and plane when viewed along the axis of said wire.

25. A method of ionizing a gas, comprising:

directing said gas along a path between a pair of concentric inner and outer electrodes; and generating in said path between said electrodes an electrostatic field having an average intensity approximately equal to the intensity of the average applied field throughout at least fifty percent of the distance from said outer electrode toward said inner electrode, and equivalent to an average intensity in air of at least 12 kv/cm at standard temperature and pressure, said field lying at right angles to said path such that said gases pass through said field and is ionized therein.

26. The method of claim 25 further including the step of adjusting the ratio between the cross sectional area of said inner electrode and the cross sectional area of said outer electrode such that said ratio is between 0.05 and 0.1.

27. The method of claim 25 wherein said field has radial and axial components in a cylindrical coordinate system, and said field, when viewed in a radial cross section of said cylindrical coordinate system, being substantially identical to the electrostatic field between a concentric wire and cylinder when viewed along the axis of said cylinder, and said field, when viewed in an axial cross section of said cylindrical coordinate system, being substantially identical to the field between a parallel wire and plane when viewed along the axis of said wire.

28. A method of ionizing gases, comprising:

moving said gases along a predetermined path between a pair of concentric inner and outer electrodes, and generating a corona discharge, electrostatic field across said path between said electrodes having an average field intensity approximately equal to the intensity of the average applied field throughout at least fifty percent of the distance from said outer electrode toward said inner electrode, and equivalent to an average intensity in air of more than 10 kv/cm at standard temperature and pressure.

29. The method of claim 28, wherein said corona discharge, electrostatic field radiates outwardly from an inner electrode in a generally wedge-shaped annular configuration such that the volume of the field outwardly of the inner electrode is greater axially of the path and circumferentially of the path for reducing the ion density and current deposition per unit area near the outer regions of the path.

30. The method of claim 29, said gases including contaminant particles, and including the step of injecting scrubber fluid into the path within the downstream residual field but only so close to the highest strength of the field so as to produce an inductive charge on the scrubber liquid of a polarity opposite the charge on the contaminants.

* * * * *